US008844102B2

(12) United States Patent
Giannetti

(10) Patent No.: US 8,844,102 B2
(45) Date of Patent: Sep. 30, 2014

(54) FUNERAL URN WITH INDEPENDENT AND SECURED ATTACHED COMPARTMENTS

(75) Inventor: Françoise Giannetti, Toulouse (FR)

(73) Assignee: MPPM, Toulouse (FR)

( * ) Notice: Subject to any disclaimer, the term of this patent is extended or adjusted under 35 U.S.C. 154(b) by 0 days.

(21) Appl. No.: 13/570,817

(22) Filed: Aug. 9, 2012

(65) Prior Publication Data

US 2014/0041168 A1 Feb. 13, 2014

(51) Int. Cl.
*A61G 17/00* (2006.01)

(52) U.S. Cl.
USPC ..... 27/1

(58) Field of Classification Search
USPC ..... 27/1; D99/5; 312/114, 117, 138.1; 220/505, 521, 528, 529
See application file for complete search history.

(56) References Cited

U.S. PATENT DOCUMENTS

| | | | | |
|---|---|---|---|---|
| 5,379,499 | A * | 1/1995 | Jackson | 27/1 |
| 5,832,575 | A * | 11/1998 | Sturino | 27/1 |
| 5,896,632 | A | 4/1999 | Sturino | |
| 6,295,705 | B1 * | 10/2001 | Gersten | 27/1 |
| 6,520,606 | B1 * | 2/2003 | Robinson | 312/111 |
| 6,735,831 | B1 * | 5/2004 | Greiwe et al. | 27/1 |
| 6,944,921 | B1 * | 9/2005 | Gersten | 27/1 |
| 7,096,546 | B2 * | 8/2006 | Poirier | 27/1 |
| 7,475,457 | B1 * | 1/2009 | Gersten | 27/1 |
| 7,739,776 | B2 * | 6/2010 | Hume | 27/35 |
| 7,950,118 | B1 * | 5/2011 | Fumo | 27/1 |
| 8,087,132 | B2 * | 1/2012 | Forrest et al. | 27/1 |
| 8,196,274 | B2 * | 6/2012 | Heckenbach | 27/1 |
| 8,281,466 | B2 * | 10/2012 | Elhaj | 27/1 |
| 2007/0152549 | A1 | 7/2007 | Champagne | |
| 2008/0116772 | A1 * | 5/2008 | Champagne | 312/117 |

FOREIGN PATENT DOCUMENTS

| | | |
|---|---|---|
| EP | 1 408 178 A1 | 4/2004 |
| WO | 00/12844 A1 | 3/2000 |

OTHER PUBLICATIONS

French Search Report, dated May 9, 2011, from corresponding French application.

* cited by examiner

*Primary Examiner* — William Miller
(74) *Attorney, Agent, or Firm* — Young & Thompson

(57) ABSTRACT

A funerary urn includes a receptacle (1) that has an opening (4) that is equipped with a removable sealing partition (11) for introducing ashes. The urn is equipped with side walls (3), a lower wall (2), and an upper wall (5), with one of the walls being removable in order to open and close the urn, the urn also including first and second inside compartments (6, 7) that each has an access element that is independent of the other and separate from the opening (4) for introducing ashes. The first compartment is equipped with a window (8) toward the outside, and the second compartment is completely concealed. The urn is designed for the perpetuation of memory because it makes it possible to preserve an emotional and material trace of the deceased individual thanks to independent compartments of the receptacle receiving the ashes.

15 Claims, 3 Drawing Sheets

FUNERAL URN WITH INDEPENDENT AND SECURED ATTACHED COMPARTMENTS

BACKGROUND OF THE INVENTION

1. Field of the Invention

This invention pertains to the field of funerary items and more particularly funeral urns.

It has as its object a funerary urn that is suitable for the perpetuation of memory that comprises, in addition to the receptacle for collecting ashes, independent inside compartments, particularly suitable for the preservation of the identity and of which one has a window toward the outside.

2. Description of the Related Art

It is known that the number of cremations has been increasing in recent years in France and in numerous European countries. With the development of cremation, but also because burial plots are located further and further geographically removed from the places of residence of the descendants, and the break-up of families, new questions are being posed today as to the symbolic and physical meaning of the death of a family member. If the gathering at the tomb of a deceased individual seems to be a less common tradition in this day and age, it nevertheless is still observed, because some people feel the need, in order to grieve, to associate a specific location with the memory of the departed. Also, the absence of a gathering site that cremation involves when the ashes are scattered itself sometimes leaves a psychological scar.

It has become necessary to respond to these changes by offering families the option of maintaining a link with their deceased family members by preserving a physical trace of the deceased, and a material token of his/her memory, offering them the option of gathering at any location where this object will be kept, an option that is very often not open to them.

There are quite a number of individuals who wish to preserve a physical trace of loved ones. However, current practice is limited to delivering to the family a funerary urn, a simple receptacle that contains the ashes, and yet whereas the cremation erases any physical trace of the deceased individuals, in this context the funerary urns can be a tangible reference for the families.

Incidentally, the French law in effect requires that funerary urns comprise a marking where the name of the deceased and that of the crematorium are specified. If the coordinates of the crematorium are in general of little importance for the descendants, in contrast the elements that identify their deceased family member, which take on a deep meaning, should be the object of a particular treatment and a presentation that exploits the emotional link.

BRIEF SUMMARY OF THE INVENTION

This is why the inventors have chosen to develop a funeral device for preserving an emotional and material trace of the deceased individual and his identity. The originality of this invention consists in the creation of an urn that can contain ashes and that comprises means for preserving a material basis for identification of the deceased individual, this material basis allowing a concrete expression of the memory and perpetual and timeless traceability of the latter, as well as the identification of his/her ashes. It makes it possible to maintain a symbolic link with the deceased and to honor his/her memory, to identify him/her in order to accompany him/her and to find him/her.

To do this, a funeral urn has been designed that comprises, aside from the receptacle that is designed to accommodate the ashes, several compartments that ensure complementary functions. It is a matter of being able to introduce the following into the urn: on the one hand, data for identification of the deceased, and, on the other hand, objects or items that are a material token of the memory of the deceased. The purpose of one of the compartments is to enclose tokens with a strong emotional tie or else for which a certain intimacy is required, whereas the purpose of the other compartment is the identification of the deceased individual by a coded element or by any other means that is authorized by law.

This is why it is essential that a first compartment be equipped with a window that presents an opening toward the outside and can exhibit an image, a photograph, an epitaph, etc., which is visible to all, while a second compartment is totally hidden from view.

In particular, the first compartment can accommodate items that comprise personalized data, visible through the window, such as a drawing that represents a likeness, an ideal, a memory, or a passage of text, for example a poem, an indication of vital statistics, a message, etc.

The second compartment can, for example, accommodate an item, pre-marked with a code, which will be deposited in reserve at the time of cremation and will then remain with the ashes, by thus creating a symbolic link and at the same time by making possible an identification of the ashes, regardless of their fate subsequently. This same code can also be affixed to the piece of the first compartment.

These pieces, which can advantageously come in the form of ceramic plates, comprise personalized data that relate to the deceased. Whereas among other functions, these data have the function of making it possible to identify the individual whose ashes are preserved, it is desirable that they provide at least the essential information of his/her vital statistics in natural language. Moreover, it is always possible to select the data that it is desired to see inscribed on this plate. They can, for example, imitate the page of an official passport-type document, which may or may not comprise a photo, or reproduce the signature of the deceased, an extract of one of his/her letters, or combine several types of said information. In an optional manner, it can also comprise coded data, as well as the address of an Internet site that lists the identification data and the codes and that also makes it possible to receive the information about the deceased on a dedicated thematic site.

The urn that is the object of this application is designed in particular for containing a timeless identification passport as it has been described in the application FR 09 02061. Actually, it is desired to be able to place in the second compartment an identification and memory device, comprising, for example, two plates of ceramic (or the like), kept attached back to back, in such a way that the first plate constitutes the front of the device and the second plate constitutes a back of said device. The plates can be of any shape, for example rectangular, in the format of a postcard or else an identity document such as a passport.

The plates are kept together by an adhesive material that occupies the entire length of the edge of the plates in such a way that the gap between the two plates is permanently closed space that can accommodate a souvenir object between the plates, hair, for example, or a material that represents the deceased. In this case, the device is sealed, and it is not possible to recover the contents therefrom, without the device being violated.

Other types of devices are known that are designed to accommodate the ashes of the deceased. For example, a display cabinet that displays, among other things, ashes in a wall case has been proposed. This display cabinet comprises a window over an outside opening to allow its contents to be seen from the outside. The purpose of such an object is exposure (a lighting system is even provided), contrary to this invention whose primary characteristics are being timeless, secured and even locked in an inviolable manner if desired. It is particularly desired that the ash receptacle as well as the compartments can be closed in a secured manner so as to preserve the objects that are contained therein, i.e., that their access is possible only using suitable tools. It thus will not be possible to remove the contents of the urn accidentally or with malicious intent. Intimacy is also protected thanks to the confidential nature of the contents of the urn.

The urns according to the invention are objects formed from a block, with an opening through a cover or by a removable bottom for the introduction of ashes. The compartments are inside the urn. Whether they are models of round shape with horizontal internal partitioning or models of faceted shape with vertical partitioning, the material that is used is preferably treated steel that can withstand high pressure.

Their design is simple: the urns of rounded shape are equipped with an access at the upper wall (the cover) that encases the entire urn from the outside. The cover can be held by inviolable screws for safety or integral locking. For the faceted urns, it is preferably the bottom plate that locks all of the compartments under the same conditions. In the two cases, the inside compartments are totally independent and secured individually on the inside and/or made inviolable. The central compartment of the urn that is used as an ash receptacle is not in contact with the attached compartments provided for the identification, and all are individually secured.

The window of the compartment that opens on the outside is provided for an incorporated identification that is visible externally. However, a variant of the urn is provided, without an outside window, for the families who would opt for an integrally closed urn. A metal identification plate would then be attached to the urn, as legislation demands.

Thus, according to the invention, the access to the different compartments is independent of the access to the receptacle that contains the ashes. This receptacle is preferably hermetically sealed and can be opened only by special tools. Actually, it is essential that the ashes be contained and strictly isolated from the outside environment, including elements that are contained in the compartments of the urn. The compartments should also open and close independently of the receptacle so as to avoid any accident or error of handling of the ashes.

The compartments are also designed to be closed independently of one another so as to access one or the other if desired, but without this being able to be done easily, by accident or without thinking. In particular, it will not be possible to initiate their manual opening, a suitable tool necessarily having to be used. In addition, the second compartment will be closed and sheltered inside the urn, in such a way that once the compartment is closed, its contents cannot be accessed either visually or by contact, without a voluntary operation of disassembly or unscrewing. The first compartment will be closed in such a way that the contents cannot be withdrawn, but the latter is at least partially visible from the outside. Thus, it will be possible to preserve a letter, a medal, a small piece of fabric, a photograph, or any other intimate memory, or else a lock of hair, or another physical substance of the deceased individual. The deceased him- or herself can, if he or she organizes his or her own funeral, provide what he or she desires to preserve.

The structure of the funeral urn that is the object of this invention meets all of the requirements set forth above.

Thus, more specifically, this invention has as its object a funerary urn that comprises a receptacle, having an opening for the introduction of ashes, with the urn being equipped with side walls, a lower wall and an upper wall, with one of said walls being removable to open and close the urn, said urn also comprising first and second inside compartments that each have an access means that is independent of one another and separate from the opening for introducing ashes, with the first compartment being equipped with a window toward the outside, and the second compartment being totally concealed.

In a general manner, a funerary urn (also called "funeral urn") is a container, a closed vase made of stone, bronze, marble, alabaster, ceramic, glass, resin, plastic and even a clay or a salt to be biodegradable, in which the family members of the deceased preserve his or her ashes after his or her cremation. An urn is designed to collect all of the ashes immediately obtained from a cremation (or three and one-half liters at a minimum).

The urn according to the invention can adopt any type of shape, the latter being part of the invention only in that it makes it possible to meet the technical characteristics defined here. It can be available as, for example, an object that is cylindrical, conical, cubic or another polyhedron that may or may not be regular, a statue or any artistic object.

The funerary urn according to the invention comprises a removable partition that seals the opening of the receptacle. This partition is not designed to be open (or only in exceptional cases); it is removable for the essential purpose of placing the ashes in the receptacle in such a way as to isolate them.

It is specified that the number of compartments of the urn can be greater than two, with the additional compartments having the characteristics of one or the other of the two compartments described below. Although these variants are not described for the sake of simplicity and clarity, it is understood that the embodiments of funeral urns with several compartments are expressly included in this invention.

According to a particular embodiment of the funerary urn according to the invention, said removable wall can be the upper wall that then constitutes a cover that works with the side walls for closing the urn.

According to another particular embodiment of the funerary urn according to the invention, said removable wall can be the lower wall that then constitutes a removable bottom that works with the side walls for closing the urn.

In an advantageous manner, the first compartment of the funerary urn according to the invention can be formed by a box that is placed vertically against a first side wall of the receptacle, said wall comprising said window. It can then be accessible, either by the top or by the bottom of the urn.

According to an alternative embodiment, the first compartment can be formed by a box that is placed horizontally under the cover of the urn, with said cover comprising said window. It is by opening the urn that said compartment can be attached or closed at the bottom of the cover, after having placed the object there that it is desired to see appear through the window.

Also, in an advantageous manner, said second compartment is formed by a box that is placed vertically against a second side wall of the receptacle. This box can be designed as the first box that is also placed against the wall, with the latter remaining sealed in this case.

According to an alternative embodiment of the invention, the second compartment is formed by a box that is placed on the partition for sealing the receptacle. In this configuration, the ashes are first placed in the receptacle, which is then closed by the sealing partition using suitable attachment means. The side walls of the urn can comprise a circular collar that defines the opening of the receptacle and that makes it possible that the partition is supported in order to be attached at the desired level. Between this level and the upper part of the cover, a space is maintained, which constitutes a chamber that can contain one of the compartments or both. In particular, once this partition is in place, a support plane is provided for installing the second compartment according to the invention.

Thus, in the funerary urn according to the invention, the space between the sealing partition of the opening of the receptacle and said cover can form a chamber, in which said first and second compartments can be attached horizontally by screwing, which may or may not be reversible. In this embodiment, the two compartments can be accessible after removal of the cover, one being attached to the bottom of the cover and the other able to be attached to the partition of the receptacle.

In another preferred embodiment of the funerary urn according to the invention, said first and second compartments are permanently attached vertically against said first and second walls, and each is equipped with an opening and closing lid that is held by screwing, which may or may not be reversible. The lids can both be accessible from the outside of the urn or from the inside (either after the cover is removed or after the plate that covers the bottom is removed as will be seen).

Actually, in accordance with the invention, a particular embodiment can provide that said inside compartments are equipped with opening and closing means that are accessible without removal of the removable wall (for example without removal of the bottom). In this case, the compartments can be arranged in such a way that their opening is made in a side wall or in the bottom of the urn, with a lid that has direct access to the outside. Accessibility is understood here as the option of seeing or reaching the compartments, in particular manipulating the means used to attach them, close them, or open them. An access means to a compartment is, for example, a flap, a lid, or any means that allows introduction into the inside space that forms said compartment.

The bottom can, for example, be formed by a plate that conceals, covering only the portion that provides access to the opening of the ash receptacle, while the inside compartments are equipped with directly accessible lids. There is no drawback on the aesthetic plane, since they are camouflaged because of their position under the urn. In this case, in an advantageous manner, said first and second compartments have a lid that constitutes a portion of the bottom of the urn. One or the other can then be opened separately according to needs, without accessing the receptacle that contains the ashes.

In contrast, according to an alternative embodiment of the funerary urn according to the invention, the two inside compartments are equipped with opening and closing means that are accessible after the removable wall of the urn is removed. For example, in the case of a model with a cover that is placed on the upper portion of the urn, the inside compartments are accessible by the top of the urn only after the cover is removed.

In the case of a model with a removable bottom, this bottom can consist of a plate that covers the entire surface, which makes it necessary to remove it to reach the inside compartments and the opening of the receptacle. The bottom can consist of a plate that conceals both the removable sealing partition of the opening for introducing ashes and the opening and closing lids of said first and second compartments.

According to the invention, preferably the cover of the funerary urn comprises a shoulder that can interlock on the side walls of the receptacle and rest on the edge of said walls. This arrangement is a convenient means for preserving the desired space to obtain a chamber that can contain two compartments.

In a very specific embodiment of the funerary urn according to the invention, the cover interlocks by sliding over the entire height of the walls of the receptacle and comprises a window that is aligned with the window of the first compartment, which can be made, for example, in the side wall of the receptacle. The cover can actually have a complementary shape of the receptacle and cover the latter partially or completely. In this case, the cover of the funerary urn that is the object of this invention advantageously comprises a window that is aligned with the window of the first compartment that is made in the side wall of the receptacle.

Furthermore, as has been emphasized above, it is generally desired that the objects that are preserved in one of the compartments, or in both, cannot be easily removed. Therefore, secured, so-called inviolable, attachment means and in particular a particular screwing that prevents the opening of the compartments after the object of memory and identification will have been placed there will preferably be used. Thus, the attachment means of said removable wall, the attachment means of said first and second inside compartments, and the attachment means of the removable partition are selected from among the safety screws of the star screw type or the mated-screw type. The secured attachment means of the opening and closing lids are preferably also selected, if necessary, from among the safety screws of the star screw type or the mated-screw type.

To do this, it is possible to use star screws (known under their trade name "Torx™ screw") that can only be disengaged using an internal hexalobular wrench approved by ISO 10664. It is also possible to use mated screws, or else any type of anti-theft or anti-vandalism screw proposed for sale by professionals.

Among the different embodiments presented here, and others that it is possible to select, it should be noted that it is advantageous to equip the urn according to the invention with different means that improve its functionality and its security. In particular, the funerary urn according to the invention can comprise one or more of the following means:

- Outside handles,
- Rubber feet, preventing shocks with the surface on which the urn will be placed,
- Sealing joints, preventing moisture from penetrating into the different compartments, chamber, or receptacle,
- A sliding drawer that equips at least one compartment and that facilitates the introduction and the removal of objects,
- Means for wedging objects that can be placed in the compartments.

It should be noted that on the cylindrical urns, the handles are secured by Torx™ screws and can be permanently locked by mating.

BRIEF DESCRIPTION OF THE DRAWINGS

This invention will be better understood, and details revealing it will appear, thanks to the description that will be made of certain variant embodiments, in relation to the accompanying figures, in which.

DETAILED DESCRIPTION OF THE PREFERRED EMBODIMENTS

EXAMPLE 1

Figure 1A:
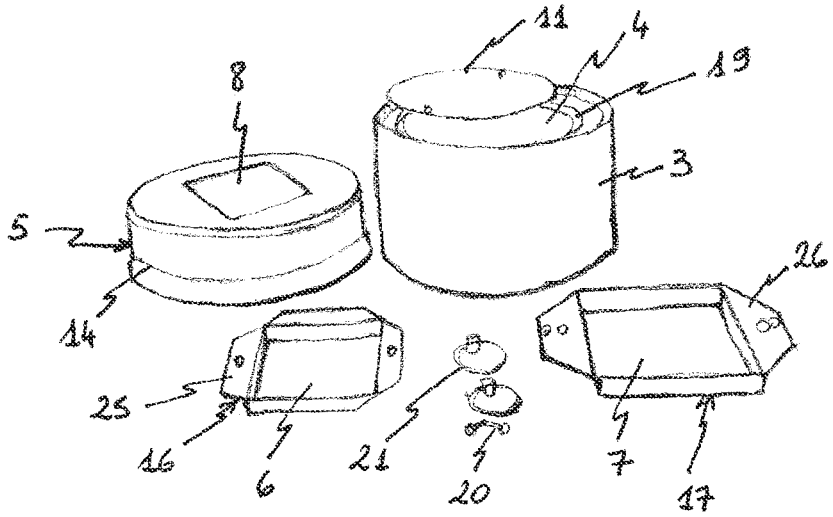
FIG. 1*a* shows in three dimensions the constituent elements of an urn according to the invention in which the inside compartments are placed horizontally.
Figure 1B:
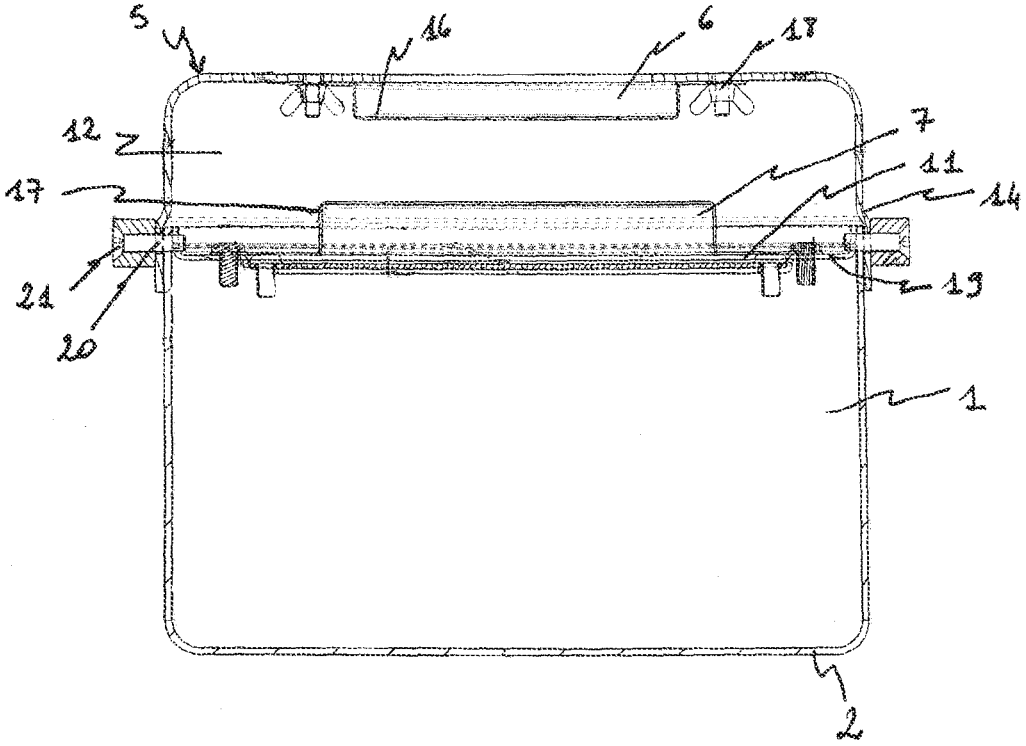
FIG. 1*b* shows a cutaway of this same urn.

FIG. 1*a* shows the different pieces of an urn before their assembly. FIG. 1*b* shows in cutaway the structure of this urn. It is a cylindrical funerary urn, comprising the receptacle 1 that is equipped with the bottom 2 and side walls 3. The opening 4 allows the introduction of ashes at the top. The cover 5 works with the receptacle 1 to close the urn.

The removable partition 11 seals the opening 4 of the receptacle 1. It rests on the circular collar 19 that defines the periphery of the opening 4 of the receptacle 1. The partition 11 is attached to the collar 19 using suitable attachment means, for example safety screws. The cover 5 of the funerary urn comprises the shoulder 14 that interlocks on the side walls 3 of the receptacle and rests on the edge of said walls. The space between the partition 11 and the cover 5 forms the chamber 12.

The urn also comprises two inside compartments, each having an access means that is independent of the other and separate from the opening for introducing ashes. The means for opening and closing the two inside compartments are accessible after the cover 5 is removed.

The first compartment 6 is formed by the box 16 that is placed horizontally under the cover 5 of the urn. This compartment is equipped with the window 8 that opens toward the outside. The box 16 is attached to the bottom of the cover 5 by the feet 25 using nuts 18.

The second compartment 7 is formed by the box 17 that is placed on the partition 11 sealing the receptacle 1. It is totally concealed. The box 17 is attached by the feet 26 using screws 19.

The two compartments are attached horizontally in said chamber by reversible screwing or by mated screws. The attachment of the cover 5 to the walls 3 of the urn is done by screwing 20, which integrates the outside handles 21.

EXAMPLE 2

Figure 2A:
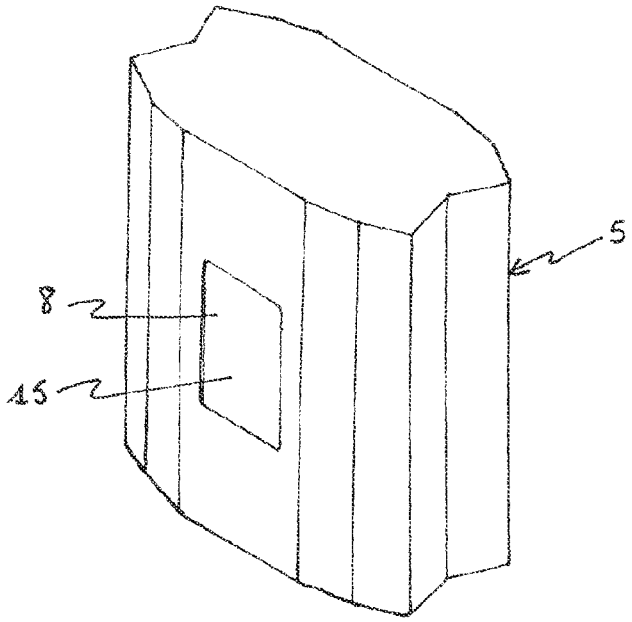
FIG. 2*a* is a three-dimensional view of a second urn in which the compartments are placed vertically.

FIG. 2*a* shows an urn according to a second embodiment. This urn has the shape of a regular polyhedron whose cross-section has the shape of a shuttle (or resembles a butterfly). It comprises a receptacle 1 that is equipped with a sealing partition (not shown) and side walls 3.

According to a variant that is illustrated in FIG. 2*a*, the cover 5 works with the receptacle 1 for closing the urn. It adopts a shape that is complementary to that of the receptacle and interlocks by sliding over the entire height of the walls 3, in such a way that it completely covers the latter. The opening that allows the introduction of ashes is located in the upper portion of the urn. The urn also comprises two inside compartments, each having an access means that is independent of the other.

The access to the compartments is made at the bottom, independently of one another. The first compartment 6 of the funerary urn is formed by the box 16 that is placed vertically against a first side wall 3' of the receptacle 1. Said wall comprises the window 8. The window 15 is cut out in the cover in such a way as to be aligned with the window 8 of the side wall of the receptacle. The second compartment 7 is formed by the box 17 that is placed vertically against the side wall 3" of the receptacle 1, opposite to the first wall 3'. This box remains sealed.

The two compartments 6, 7 are permanently attached vertically against the walls 3', 3", for example by welding. They are each equipped with an opening and closing lid 13', 13" and covered by the bottom of the urn.

Figure 2B:
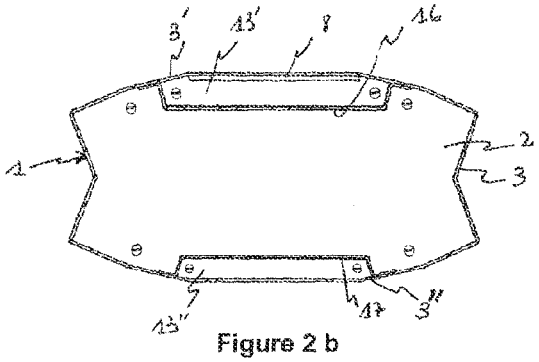
FIGS. 2*b* and 2*c* are bottom views of other urns of the same shape.
Figure 2C:
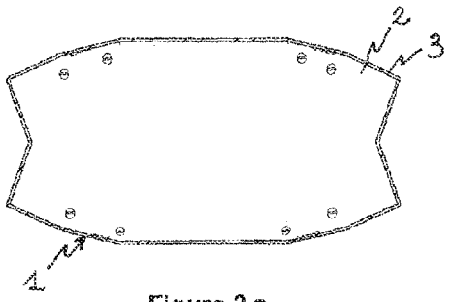

According to a variant that is illustrated in FIG. 2*c*, the bottom is formed by a single plate that is to be removed in order to have access to the inside compartments.

EXAMPLE 3

According to another variant that is illustrated in FIG. 2*b*, the urn adopts the same outside shape, but the side walls 3 are not covered. The opening 4 of the receptacle 1 that makes possible the introduction of the ashes is located in the lower wall 2 of the urn. The urn also comprises two inside compartments 6, 7 that each has an access means that is independent of the other and separate from the opening for introducing ashes. The opening and closing means 13', 13" of the two inside compartments 6, 7 are accessible without removing the plate 22.

The first compartment 6 of the funerary urn is formed by the box 16 that is placed vertically against a first side wall 3' of the receptacle 1. Said wall comprises the window 8. The second compartment 7 is formed by the box 17 that is placed vertically against the side wall 3" of the receptacle 1, opposite the first wall 3'. This box remains sealed.

The two compartments 6, 7 are permanently attached vertically against the walls 3', 3", for example by welding. They are each equipped with an opening and closing lid 13', 13", covered by the bottom of the urn. The lids are held by star screws with reversible screwing. The bottom of the urn is equipped with rubber feet (not shown).

EXAMPLE 4

Figure 3A:
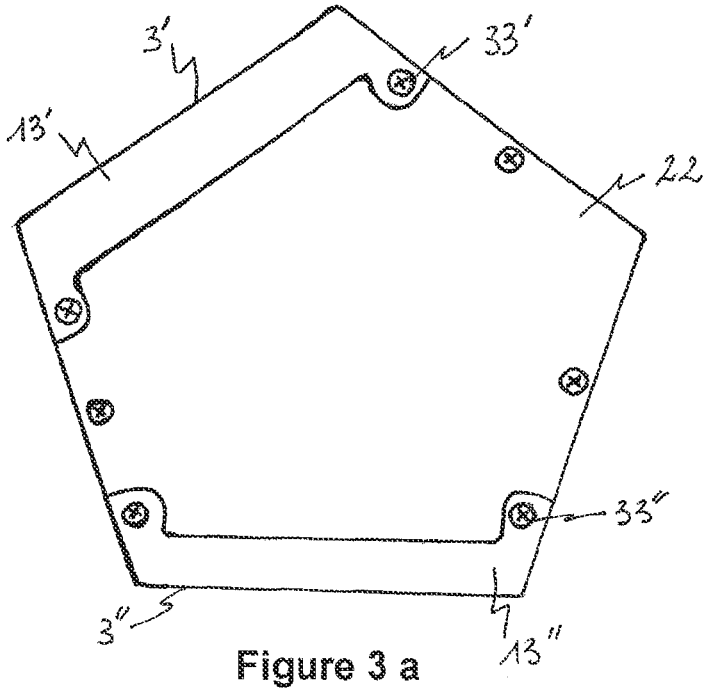
FIGS. 3*a* and 3*b* are bottom views of a pentahedral urn, with direct access to the compartments (FIG. 3*a*) and without direct access (FIG. 3*b*).
Figure 3B:
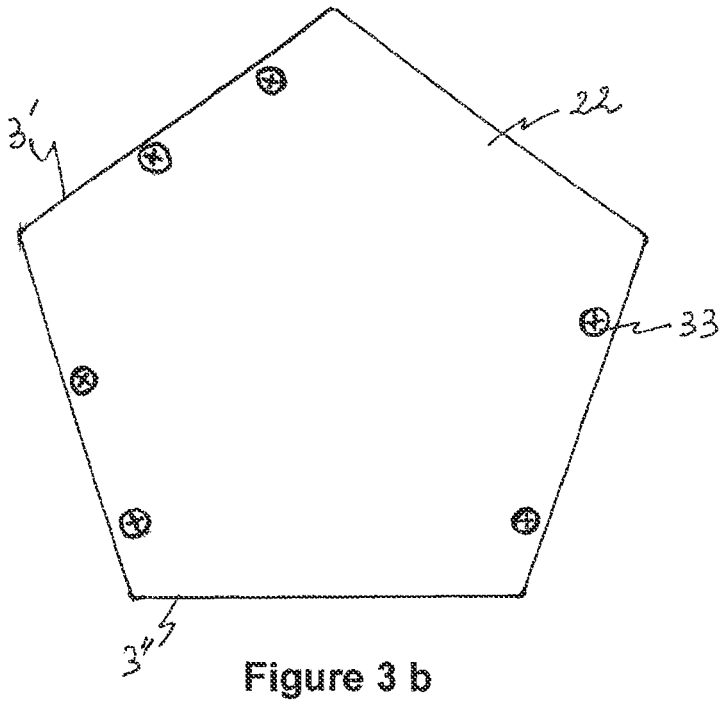

FIGS. 3*a* and 3*b* are bottom views of two pentahedral urns. The first compartment 6 is attached vertically against the first side wall 3', and the second compartment 7 is attached vertically against the second wall 3".

The first urn (FIG. 3*a*) has direct access to the inside compartments without it being necessary to remove the removable wall of the urn, thanks to an opening and closing lid 13', 13" with which the compartments are equipped. The lids 13', 13" are held by the screws 33', 33". The plate 22 adopts a complementary shape for covering the remainder of the bottom of the urn and for ensuring the closing of the receptacle.

The second urn (FIG. 3*b*) has a bottom that is formed by a single plate that is to be removed in order to have access to the inside compartments. The plate 22 adopts a pentahedral shape for covering the bottom of the urn completely. It is held by the safety screws 33. It conceals both the sealing partition 11 of the receptacle 1 for introducing ashes, and the opening and closing lids 13', 13" of the inside compartments 6, 7. The inside compartments 6, 7 are equipped with opening and closing means that are separate from the plate 22, visible and accessible only after the removable plate 22 is removed from the urn.

The invention claimed is:

1. A funerary urn comprising:

a receptacle that has an opening that is equipped with a removable sealing partition, the opening being configured to receive ashes, the receptacle including side walls, a lower wall, and an upper wall, one of the lower wall and the upper wall being a removable wall to open and close the urn; and inside first and second compartments that each include an access means that is independent of the other access means and separate from the opening configured to receive the ashes, the first compartment being equipped with a window toward the outside, and the second compartment being completely concealed.

2. The funerary urn according to claim 1, wherein the removable wall is the upper wall that constitutes a cover that works with the side walls to close the urn.

3. The funerary urn according to claim 2, wherein a space between the sealing partition of the opening of the receptacle and the cover forms a chamber in which the first and second compartments are attached horizontally by screwing.

4. The funerary urn according to claim 2, wherein the cover of the urn comprises a shoulder that can interlock on the side walls of the receptacle and can rest on an edge of the side walls.

5. The funerary urn according to claim 2, wherein the cover interlocks by sliding over the entire height of the side walls of the receptacle, the cover comprising a window that is aligned with the window of the first compartment.

6. The funerary urn according to claim 1, wherein said removable wall is the lower wall that constitutes a removable bottom that works with the side walls to close the urn.

7. The funerary urn according to claim 6, wherein the access means of the first and second compartments are opening and closing means that are accessible after the removable wall is removed from the urn.

8. The funerary urn according to claim 7, wherein the removable bottom consists of a plate that conceals both the removable sealing partition of the opening configured to receive the ashes and opening and closing lids of the first and second compartments, the opening and closing lids being the opening and closing means.

9. The funerary urn according to claim 1, wherein the first compartment is formed by a box that is placed vertically against a first side wall of the side walls of the receptacle, the first side wall comprising the window.

10. The funerary urn according to claim 9, wherein the second compartment is formed by a box that is placed vertically against a second side wall of the side walls of the receptacle.

11. The funerary urn according to claim 1, wherein the first compartment is formed by a box that is placed horizontally under a cover of the urn, the cover comprising the window.

12. The funerary urn according to claim 1, wherein the second compartment is formed by a box that is placed on the sealing partition of the receptacle.

13. The funerary urn according to claim 1, wherein, the first and second compartments are permanently attached vertically against first and second side walls of the side walls, and the access means of each of the first and second compartments is an opening and closing lid that is held by screwing.

14. The funerary urn according to claim 1, wherein the access means of the first and second compartments are opening and closing means accessible without removing the removable wall from the urn.

15. The funerary urn according to claim 1, further comprising:

means for attaching the removable wall;

means for attaching the first and second inside compartments; and means for attaching the removable partition that are selected from among safety screws of a star-shaped screw or a mated-shaped screw.

* * * * *